US010768556B2

(12) United States Patent
Shibuya

(10) Patent No.: US 10,768,556 B2
(45) Date of Patent: Sep. 8, 2020

(54) IMAGE FORMING APPARATUS

(71) Applicant: KYOCERA Document Solutions Inc., Osaka (JP)

(72) Inventor: Teppei Shibuya, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/721,347

(22) Filed: Dec. 19, 2019

(65) Prior Publication Data

US 2020/0225612 A1 Jul. 16, 2020

(30) Foreign Application Priority Data

Jan. 11, 2019 (JP) ..... 2019-003626

(51) Int. Cl.
*G03G 15/16* (2006.01)
*G03G 15/00* (2006.01)

(52) U.S. Cl.
CPC ..... *G03G 15/161* (2013.01); *G03G 15/1615* (2013.01); *G03G 15/5037* (2013.01); *G03G 2215/00151* (2013.01)

(58) Field of Classification Search
CPC ..... G03G 15/161; G03G 15/1615; G03G 2215/00143
See application file for complete search history.

(56) References Cited

U.S. PATENT DOCUMENTS

2008/0260424 A1* 10/2008 Hara ..... G03G 15/161 399/121
2013/0112530 A1* 5/2013 Fujii ..... G03G 15/1615 198/617
2015/0078792 A1* 3/2015 Aoyagi ..... G03G 15/1615 399/302
2017/0168427 A1* 6/2017 Sasaki ..... G03G 15/1615

FOREIGN PATENT DOCUMENTS

JP 5-134486 5/1993

* cited by examiner

*Primary Examiner* — Thomas S Giampaolo, II
(74) *Attorney, Agent, or Firm* — Stein IP, LLC

(57) ABSTRACT

An image forming apparatus includes a plurality of image forming portions, an intermediate transfer belt, a belt displacement detector, an attraction force changer, and a controller. The intermediate transfer belt is an endless belt wound around drive and driven rollers. The belt displacement detector detects displacement of the intermediate transfer belt in a rotation axis direction of the driven roller. The attraction force changer is operable to change electrostatic attraction force of the driven roller with respect to the intermediate transfer belt exerted on each of opposite end sides of the driven roller in the rotation axis direction thereof. When the belt displacement detector detects displacement of the intermediate transfer belt, the controller makes the attraction force changer increase the electrostatic attraction force of the driven roller with respect to the intermediate transfer belt exerted on a side opposite to a side toward which the displacement has taken place.

7 Claims, 6 Drawing Sheets

IMAGE FORMING APPARATUS

INCORPORATION BY REFERENCE

This application is based upon and claims the benefit of priority from the corresponding Japanese Patent Application No. 2019-003626 filed on Jan. 11, 2019, the entire contents of which are incorporated herein by reference.

BACKGROUND

The present disclosure relates to an image forming apparatus.

As an example of electro-photographic image forming apparatuses such as a copier and a printer, there has been known an intermediate-transfer type image forming apparatus which primarily transfers toner images of different colors, respectively formed by a plurality of image forming portions, onto an intermediate transfer belt to be sequentially superimposed one on another on the intermediate transfer belt, which is arranged along the plurality of image forming portions, and then secondarily transfers the toner images from the intermediate transfer belt onto a sheet. About the image forming apparatus of this type, it is feared that there is a risk of the intermediate transfer belt meandering or twisting. To cope with this risk, there have been proposed image forming apparatuses capable of suppressing occurrence of meandering and twisting of the intermediate transfer belt.

In an example of such image forming apparatuses, of an outer circumferential surface of a roller around which a belt is wound, a central part in a rotation-axis direction is a high friction-coefficient surface, and opposite side parts in the rotation-axis direction are low friction-coefficient surface. Thus, the roller exerts a stronger belt conveying force in its central part than in its opposite side parts, and as a result, the belt is constantly being drawn toward the central part of the roller. This function helps prevent meandering of the belt.

SUMMARY

According to one aspect of the present disclosure, an image forming apparatus includes a plurality of image forming portions, an intermediate transfer belt, a belt displacement detector, an attraction force changer, and a controller. The plurality of image forming portions form toner images of different colors. The intermediate transfer belt is an endless belt wound around a drive roller and a driven roller, and is arranged along the plurality of image forming portions, and onto the intermediate transfer belt. The toner images respectively formed by the plurality of image forming portions are primarily transferred onto the intermediate transfer belt to be sequentially superimposed one on another. The belt displacement detector detects displacement of the intermediate transfer belt in a rotation axis direction of the driven roller. The attraction force changer is operable to change electrostatic attraction force of the driven roller with respect to the intermediate transfer belt exerted on each of opposite end sides of the driven roller in the rotation axis direction thereof. The controller controls operation of the attraction force changer. When the belt displacement detector detects the displacement of the intermediate transfer belt, the controller makes the attraction force changer increase the electrostatic attraction force of the driven roller with respect to the intermediate transfer belt exerted on a side of the driven roller opposite to a side toward which the displacement has taken place.

DETAILED DESCRIPTION

An embodiment of the present disclosure will be described below with reference to the accompanying drawings. It should be noted that the present disclosure is not limited to what is specifically mentioned below.

Figure 1:
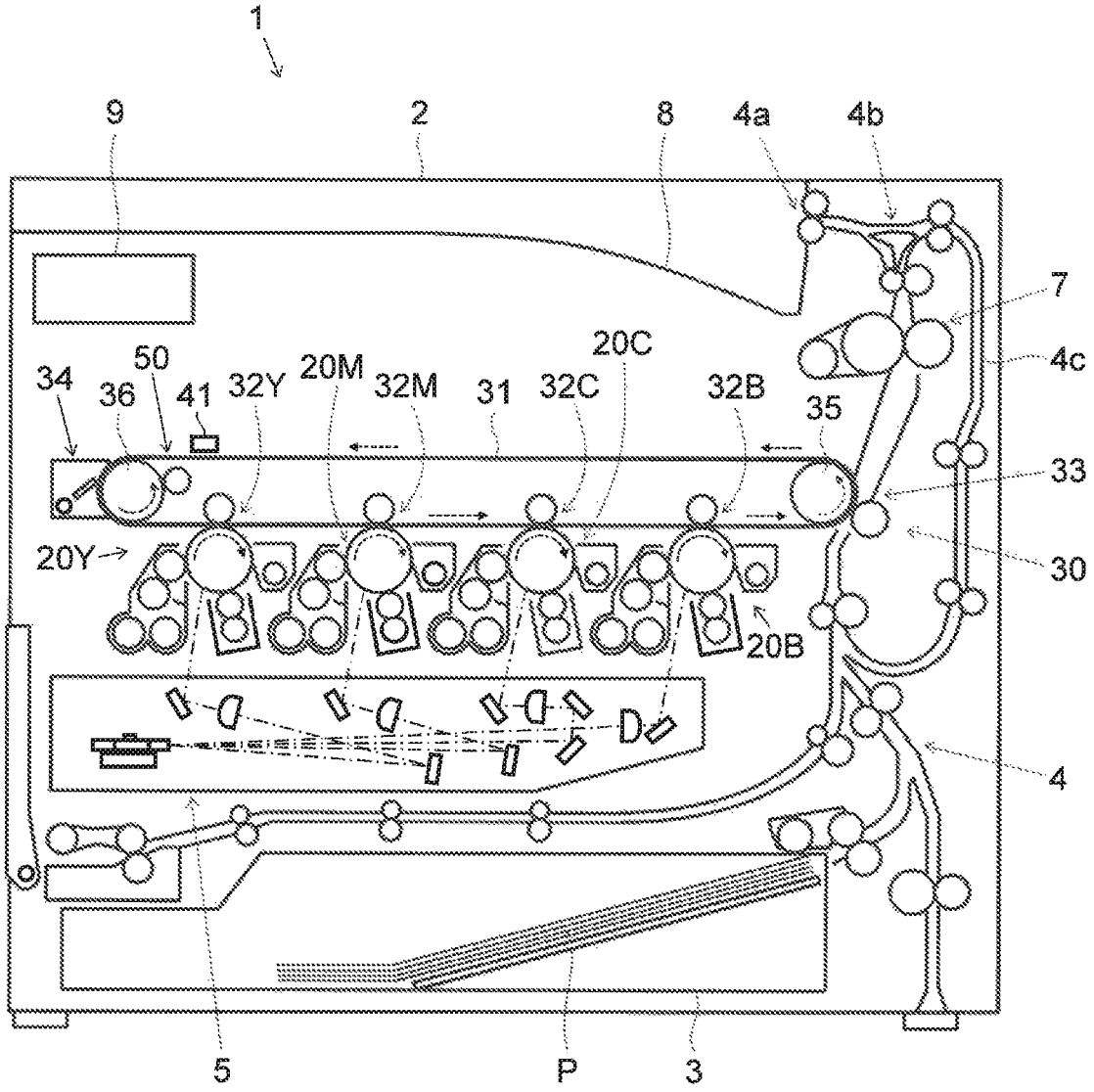
FIG. 1 is a schematic sectional view showing a configuration of an image forming apparatus according to an embodiment of the present disclosure.
Figure 2:
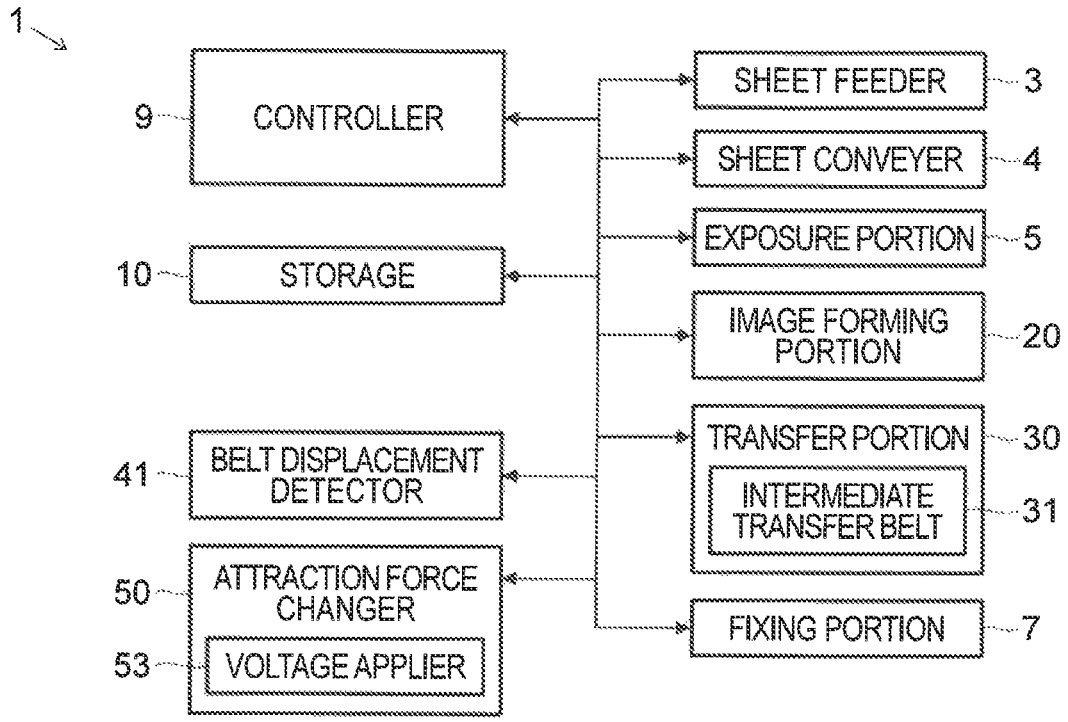
FIG. 2 is a block diagram showing a configuration of the image forming apparatus according to the embodiment of the present disclosure.
Figure 3:
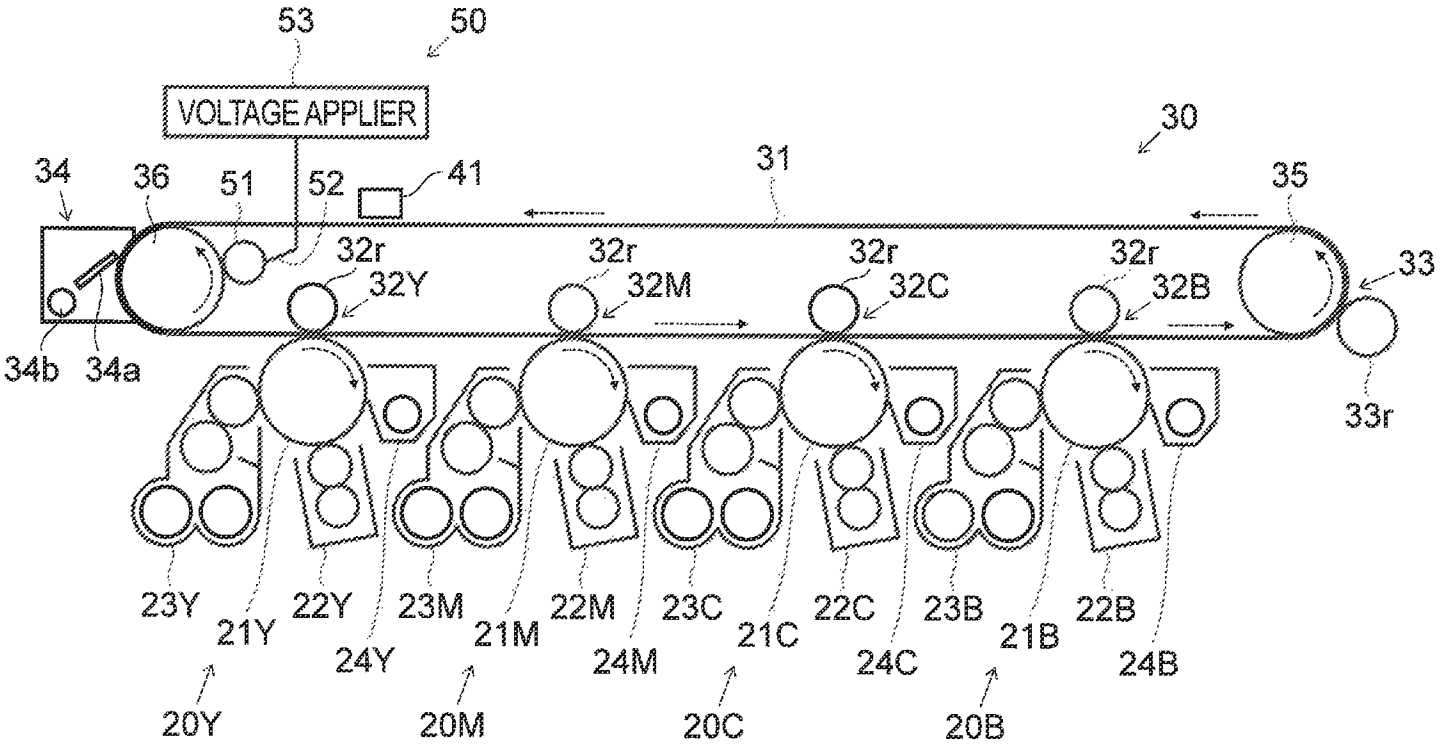
FIG. 3 is a sectional view showing an area around a transfer portion of the image forming apparatus according to the embodiment of the present disclosure.

FIG. 1 is a schematic sectional view showing a configuration of an image forming apparatus 1. FIG. 2 is a block diagram showing a configuration of the image forming apparatus 1. FIG. 3 is a sectional view showing an area around a transfer portion 30 of the image forming apparatus 1. An example of the image forming apparatus 1 according to the present embodiment is a tandem-type color printer which uses an intermediate transfer belt 31 to transfer a toner image onto a sheet P. The image forming apparatus 1 may instead be what is called a multifunction peripheral which has, for example, a print function (printing), a scan function (in age reading), a facsimile function, etc.

As shown in FIG. 1, FIG. 2, and FIG. 3, the image forming apparatus 1 includes the following components arranged in a main body 2 thereof a sheet feeder 3, a sheet conveyer 4, an exposure portion 5, an image forming portion 20, the transfer portion 30, a fixing portion 7, a sheet discharge portion 8, a controller 9, and a storage 10.

The sheet feeder 3 holds a plurality of sheets F, and feeds them out separately one by one in printing. The sheet conveyer 4 conveys the sheets P fed out from the sheet feeder 3 to a secondary transfer portion 33 and the fixing portion 7, and further delivers the sheets P, having undergone image fixing, to the sheet discharge portion 8 via a sheet discharge port 4*a*. When double-side printing is to be performed, the sheet conveyer 4 guides the sheets P, each having undergone image fixing on a first side thereof, to a reverse sheet conveyer 4*c* via a branch portion 4*b*, and conveys the sheets P back to the secondary transfer portion 33 and the fixing portion 7. The exposure portion 5 radiates, toward the image forming portion 20, laser light L controlled based on image data.

The image forming portion 20 includes a yellow image forming portion 20Y, a magenta image forming portion 20M, a cyan image forming portion 20C, and a black image forming portion 20B. These four image forming portions 20 are identical in basic configuration. Thus, in the following description, the color identification symbols "Y", "M", "C", and "B" may be omitted unless necessary for specific identification.

The image forming portions 20 each include a photosensitive drum 21, which is an image carrier supported to be rotatable in a predetermined direction (a clockwise direction in FIG. 1 and FIG. 3). The image forming portions 20 each further include a charging portion 22, a developing portion 23, and a drum cleaning portion 24, which are arranged around the photosensitive drum 21 along the rotation direction thereof. Between the developing portion 23 and the drum cleaning portion 24, a primary transfer portion 32 is arranged.

The charging portion 22 charges the outer circumferential surface of the photosensitive drum 21 at a predetermined potential by means of a charging roller, for example. Then, a laser beam radiated from the exposure portion 5 forms an electrostatic latent image of a document image on the outer circumferential surface of the photosensitive drum 21. That is, the photosensitive drum 21, as an image carrier, carries an electrostatic latent image. The developing portion 23 supplies toner to the electrostatic latent image to forrn a toner image. The four image forming portions 20 form toner images of different colors.

The transfer portion 30 includes the intermediate transfer belt 31, primary transfer portions 32Y, 32M, 32C, and 32B, the secondary transfer portion 33, and a belt cleaning portion 34. The intermediate transfer belt 31 is an intermediate transfer body which is supported to be rotatable in a predetermined direction (a counterclockwise direction in FIG. 1 and FIG. 3), and onto which toner images formed by the four image forming portions 20 are primarily transferred to be sequentially superimposed one on another. The four image forming portions 20 are arranged in what is called a tandem alignment, being aligned from upstream to downstream sides of the intermediate transfer belt 31 in a rotation direction thereof.

The primary transfer portions 32Y, 32M, 32C, and 32B are arranged above the image forming portions 20Y, 20M, 20C, and 20B corresponding to different colors. The secondary transfer portion 33 is arranged at a position that is on an upstream side of the fixing portion 7 in a sheet-conveyance direction in the sheet conveyer 4 and that is on a downstream side of the image forming portions 20Y, 20M, 20C, and 20B, corresponding to the different colors, in a rotation direction of the intermediate transfer belt 31 in the transfer portion 30. The belt cleaning portion 34 is arranged on an upstream side of the image forming portions 20Y, 20M, 20C, and 20B, corresponding to the different colors, in the rotation direction of the intermediate transfer belt 31.

Toner images are primarily transferred onto the outer circumferential surface of the intermediate transfer belt 31 at the primary transfer portions 32Y, 32M, 32C, and 32B, corresponding to the different colors. Then, along with the rotation of the intermediate transfer belt 31, the toner images on the image forming portions 20 are transferred one after another onto the intermediate transfer belt 31 with a predetermined timing to be superimposed one on another. In this manner, the yellow, magenta, cyan, and black toner images are superimposed one on another on the outer circumferential surface of the intermediate transfer belt 31, forming a color toner image. The drum cleaning portion 24 performs cleaning by removing toner and the like remaining on the outer circumferential surface of the photosensitive drum 21 after the primary transfer.

The color toner image on the outer circumferential surface of the intermediate transfer belt 31 is transferred onto a sheet P, which has been synchronously conveyed by the sheet conveyer 4, at a secondary transfer nip portion formed in the secondary transfer portion 33. The belt cleaning portion 34 performs cleaning by removing toner and the like remaining on the outer circumferential surface of the intermediate transfer belt 31 after the secondary transfer.

The fixing portion 7 applies heat and pressure to the sheet P having the toner image transferred thereon, and thereby fixes the toner image on the sheet P.

The controller 9 includes a CPU, an image processor, and other electronic circuits and electronic components, of which none is illustrated. The CPU performs processing related to the functions of the image forming apparatus 1 by controlling the operation of each component provided in the image forming apparatus 1 based on programs and data for control stored in the storage 10. The sheet feeder 3, the sheet conveyer 4, the exposure portion 5, the image forming portion 20, the transfer portion 30, and the fixing portion 7 each individually receive instructions from the controller 9 and operate together to perform printing with respect to the sheet P. Furthermore, the controller 9 is also capable of obtaining an output value from a belt displacement detector 41, which will be described later, to control the operation of an attraction force changer 50, which will also be described later.

The storage 10 is configured with, for example, a combination of a non-volatile storage device, such as a program ROM (Read Only Memory) and a data ROM, and a volatile storage device, such as a RAM (Random Access Memory), of which none is illustrated.

Figure 4:
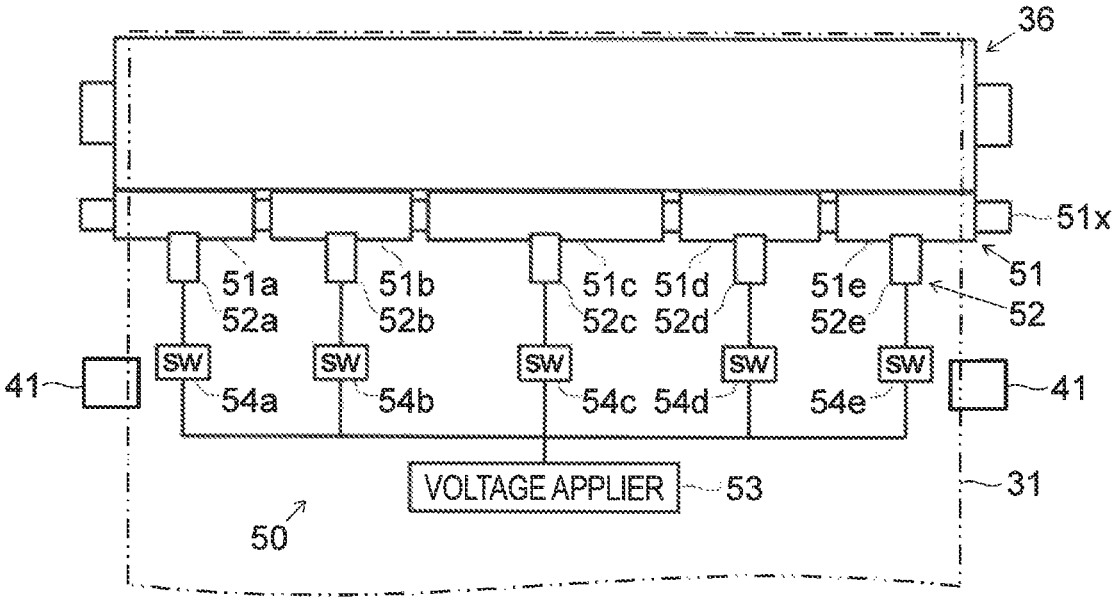
FIG. 4 is a top view showing an area around a driven roller of the image forming apparatus according to the embodiment of the present disclosure.

Next, a configuration of and around the transfer portion 30 will be described by using FIG. 3 and FIG. 4. FIG. 4 is a top view showing an area around a driven roller 36 of the image forming apparatus 1.

The intermediate transfer belt 31 is an endless belt wound around a drive roller 35 and the driven roller 36. The intermediate transfer belt 31 is made to rotate in the counterclockwise direction in FIG. 3 by the drive roller 35 powered by an unillustrated drive motor. The driven roller 36 rotates in the counterclockwise direction in FIG. 3 following the rotation of the intermediate transfer belt 31. In the secondary transfer portion 33, a secondary transfer roller 33*r* is arranged. The secondary transfer roller 33*r* is opposed to the drive roller 35 with the intermediate transfer belt 31 interposed between them, and is in contact with the outer circumferential surface of the intermediate transfer belt 31.

The intermediate transfer belt 31 is arranged along the four image forming portions 20. Above each of the four image forming portions 20, a primary transfer roller 32*r* is arranged, with the intermediate transfer belt 31 interposed between them. The primary transfer roller 32*r* is opposed to the photosensitive drum 21 with the intermediate transfer belt 31 interposed between them, and is in contact with an inner circumferential surface of the intermediate transfer belt 31.

The intermediate transfer belt 31 is a conductive belt having a multilayer structure that includes, in order from the inner circumferential side, a base layer, an elastic layer, and a coat layer, for example. The base layer is made of, for example, a PVDF (polyvinylidene difluoride) resin, a polyimide resin, and the like, and has a predetermined rigidity as a base member. The elastic layer is made of, for example, a hydrin rubber, a polychioroprene rubber, a polyurethane rubber, and the like, and has an elasticity to prevent a dropout phenomenon in an image caused by stress concentration. The coat layer is made of, for example, an acrylic resin, a silicone resin, a fluororesin, and the like, and protects the elastic layer. The coat layer, constituting the outer circumference surface, contacts the photosensitive drum 21 and the secondary transfer roller 33*r*.

Here, the intermediate transfer belt 31 may instead have a structure without a base layer, a structure including another layer in addition to a base layer, an elastic layer, and a coat layer, or a monolayer structure having only an elastic layer.

The belt cleaning portion 34 is opposed to the driven roller 36 with the intermediate transfer belt 31 interposed between them, and is in contact with the outer circumferential surface of the intermediate transfer belt 31. The belt cleaning portion 34 includes, for example, a scraper 34*a* and a spiral conveyer 34*b*. The scraper 34*a* is in contact with the outer circumferential surface of the intermediate transfer belt 31, and scrapes off toner and the like remaining on the outer circumferential surface of the intermediate transfer belt 31 after secondary transfer. The spiral conveyer 34*b* conveys the toner and the like having been scraped off by the scraper 34*a* from the outer circumferential surface of the intermediate transfer belt 31 into an unillustrated exhaust toner collection container provided outside the belt cleaning portion 34.

Further, the image forming apparatus 1 includes the belt displacement detector 41 and the attraction force changer 50. The belt displacement detector 41 and the attraction force changer 50 are arranged near the driven roller 36.

The belt displacement detector 41 is arranged, for example, as shown in FIG. 3 and FIG. 4, on an upstream side of the driven roller 36 in the rotation direction of the intermediate transfer belt 31. The belt displacement detector 41 is arranged at each of opposite end portions of the intermediate transfer belt 31 in the rotation axis direction. The belt displacement detector 41 has, for example, an actuator and a transmissive optical sensor (of which neither is illustrated). The actuator swings when it comes into contact with the intermediate transfer belt 31. The optical sensor detects blockage of the optical path caused by the swinging actuator. The belt displacement detector 41 detects displacement of the intermediate transfer belt 31 in the rotation axis direction of the driven roller 36. A detection signal from the belt displacement detector 41 is fed to the controller 9.

The attraction force changer 50 includes a rotation body 51, a contact member 52, a voltage applier 53, and a switch 54.

The rotation body 51 is arranged, as shown in FIG. 4, adjacent to the driven roller 36. The rotation body 51 has a rotation axis that is parallel to the rotation axis of the driven roller 36. The rotation body 51 rotates in contact with the outer circumferential surface of the driven roller 36 substantially over the entire area in the rotation axis direction of the driven roller 36. The rotation body 51 is constituted by a foam or solid conductive rubber roller, a brush roller using conductive threads, or the like.

The rotation body 51 is divided into a plurality of regions in the rotation axis direction thereof. The rotation body 51 is divided into, for example, five regions 51*a*, 51*b*, 51*c*, 51*d*, and 51*e* in its rotation axis direction. The five regions 51*a*, 51*b*, 51*c*, 51*d*, 51*e* of the rotation body 51 are fixed to an axis portion 51*x* at predetermined intervals in the rotation axis direction of the rotation body 51. Here, the number of regions into which the rotation body 51 is divided is not restricted to five. An outer circumferential surface of the rotation body 51 is preferably divided into at least three regions including a central part (the region 51*c*) and opposite end parts (regions 51*a* and 51*e*) in the rotation axis direction of the rotation body 51.

The contact member 52 is arranged adjacent to the rotation body 51. The contact member 52 is constituted by, for example, a conductive plate spring, a bar-shaped brush using conductive threads, or the like. The contact member 52 is in contact with an outer circumferential portion of the rotation body 51, and leads electricity outputted from the voltage applier 53 to the rotation body 51. The contact member 52 includes five contact members 52*a*, 52*b*, 52*c*, 52*d*, and 52*e* corresponding to the five regions 51*a*, 51*b*, 51*c*, 51*d*, and 51*e*, respectively, of the rotation body 51. The contact members 52*a*, 52*b*, 52*c*, 52*d*, and 52*e* are individually in contact with the five regions 51*a*, 51*b*, 51*c*, 51*d*, and 51*e*, respectively, of the rotation body 51.

The voltage applier 53 includes a power supply and a control circuit (of which neither is illustrated). The voltage applier 53 is electrically connected with the contact members 52*a*, 52*b*, 52*c*, 52*d*, and 52*e* via switches 54*a*, 54*b*, 54*c*, 54*d*, and 54*e*. The voltage applier 53 applies voltage to the five regions 51*a*, 51*b*, 51*c*, 51*d*, and 51*e* of the rotation body 51 via the contact members 52*a*, 52*b*, 52*c*, 52*d*, and 52*e*. The five separate regions 51*a*, 51*b*, 51*c*, 51*d*, and 51*e* of the rotation body 51 are in contact with substantially an entire area of an outer circumferential surface of the driven roller 36 in its rotation axis direction. This enables the attraction force changer 50 to change the electrostatic attraction force of the driven roller 36 with respect to the intermediate transfer belt 31 exerted on each of the opposite end sides of the driven roller 36 in its rotation axis direction.

In a case where the belt displacement detector 41 has detected the displacement of the intermediate transfer belt 31, the controller 9 makes the attraction force changer 50 increase the electrostatic attraction force of the driven roller 36 with respect to the intermediate transfer belt 31 exerted on the side of the driven roller 36 opposite to the side toward which the intermediate transfer belt 31 has been displaced.

Specifically, for example, when the belt displacement detector 41 detects a rightward displacement of the intermediate transfer belt 31 in FIG. 4, the controller 9 makes the voltage applier 53 raise the voltage applied to the left side in FIG. 4, that is, the voltage applied to at least one of the regions 51*a* and 51*b* of the rotation body 51. That is, in a case where the intermediate transfer belt 31 has been displaced rightward, the controller 9 increases the electrostatic attraction force of the driven roller 36 with respect to the intermediate transfer belt 31 exerted on the left-side part of the driven roller 36. This forces the intermediate transfer belt 31 to move leftward, back into its appropriate position.

In contrast, for example, when the belt displacement detector 41 detects a leftward displacement of the intermediate transfer belt 31 in FIG. 4, the controller 9 makes the voltage applier 53 raise the voltage applied to the right side in FIG. 4, that is, the voltage applied to at least one of the regions 51*e* and 51*d* of the rotation body 51. That is, in a case where the intermediate transfer belt 31 has been displaced leftward, the controller 9 increases the electrostatic attraction force of the driven roller 36 with respect to the intermediate transfer belt 31 exerted on the right-side part of the driven roller 36. This forces the intermediate transfer belt 31 to move rightward, back into its appropriate position.

Here, the voltage applied by the voltage applier 53 is preferably raised or lowered in accordance with the level of displacement of the intermediate transfer belt 31. For example, the larger the displacement of the intermediate transfer belt 31 is, the more the voltage applied by the voltage applier 53 is raised. In a case where the displacement of the intermediate transfer belt 31 is of such a level as will cause no problem in image forming operation, the voltage applied by the voltage applier 53 may be turned off. A voltage may be applied to the region 51*c* in the central part in the axial direction, depending on the level of displacement of the intermediate transfer belt 31.

With the configuration described above, when the intermediate transfer belt 31 has been displaced, the electrostatic attraction force of the driven roller 36 with respect to the intermediate transfer belt 31 can be increased on the side opposite to the side toward which the displacement has taken place. This makes it possible to move the intermediate transfer belt 31 in a direction opposite to the direction in which the intermediate transfer belt 31 has been displaced. Thus, it is possible to keep suppressing meandering and twisting of the intermediate transfer belt 31 over a long period of time, without any component being worn out. Further, it is also possible to suppress complication of the structure, and thus to achieve a compact and simple image forming apparatus 1.

The attraction force changer 50 includes the rotation body 51 configured as described above, the contact member 52, and the voltage applier 53. With this configuration, it is possible to apply voltage indirectly to the driven roller 36 via the rotation body 51. For example, in a case where the belt cleaning portion 34 is opposed to the driven roller 36 with the intermediate transfer belt 31 interposed between them, and is in contact with the outer circumferential surface of the intermediate transfer belt 31, the outer circumferential surface of the driven roller 36 needs to have a shape that does not have any stepped portion over the entire area in the rotation axis direction. This can be achieved with the attraction force changer 50 configured as described above by changing the electrostatic attraction force of the driven roller 36 with respect to the intermediate transfer belt 31 exerted on each of the opposite end sides of the driven roller 36 in its rotation axis direction.

Figure 5:
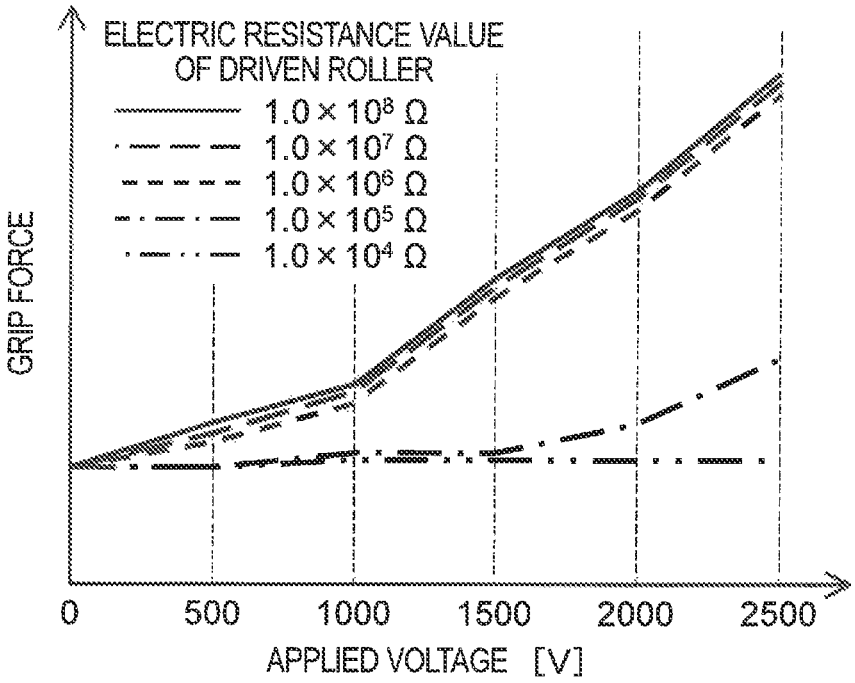
FIG. 5 is a graph showing a relationship between the electric resistance value and the grip force of the driven roller in each of image forming apparatuses according to an example and a comparative example.

FIG. 5 is a graph showing a relationship between the electric resistance value and the grip force of the driven roller 36. Specifically, FIG. 5 is a diagram showing the change of grip force of an outer circumferential surface of each of five driven rollers that was observed when the voltage applied to the outer circumferential surface was gradually raised in each of the five driven rollers, the five driven rollers having different electric resistance values under application of the voltage of 100 V thereto.

From FIG. 5, it is clear that, in the driven roller of which the electric resistance value when the voltage of 100 V is applied thereto is equal to or smaller than $1.0\times10_5\Omega$, the grip force does not greatly rise even when the applied voltage is raised. In contrast, it is clear that, in the driven roller of which the electric resistance value when the voltage of 100 V is applied thereto is equal to or larger than $1.0\times10^6\Omega$, the grip force rises as the applied voltage is raised. Thus, it is preferable that the electric resistance value of the driven roller when the voltage of 100 V is applied thereto be equal to or larger than $1.0\times10^6\Omega$.

Further, it is preferable that the friction coefficient of the outer circumferential surface of the driven roller 36 with respect to the intermediate transfer belt 31 be smaller than that of the outer circumferential surface of the drive roller 35 with respect to the intermediate transfer belt 31. With this configuration, the intermediate transfer belt 31 can move smoothly on the outer circumferential surface of the driven roller 36. This makes it easy to draw the displaced intermediate transfer belt 31 back into its appropriate position.

Further, it is preferable that the surface hardness of the driven roller 36 be higher than that of the drive roller 35. With this configuration, the intermediate transfer belt 31 can move smoothly on the outer circumferential surface of the driven roller 36. This makes it easy to draw the displaced intermediate transfer belt 31 back into its appropriate position.

Further, it is preferable that a lubricant be applied to the outer circumferential surface of the driven roller 36. With this configuration, the intermediate transfer belt 31 can move smoothly on the outer circumferential surface of the driven roller 36. This makes it easy to draw the displaced intermediate transfer belt 31 back into its appropriate position.

Figure 6:
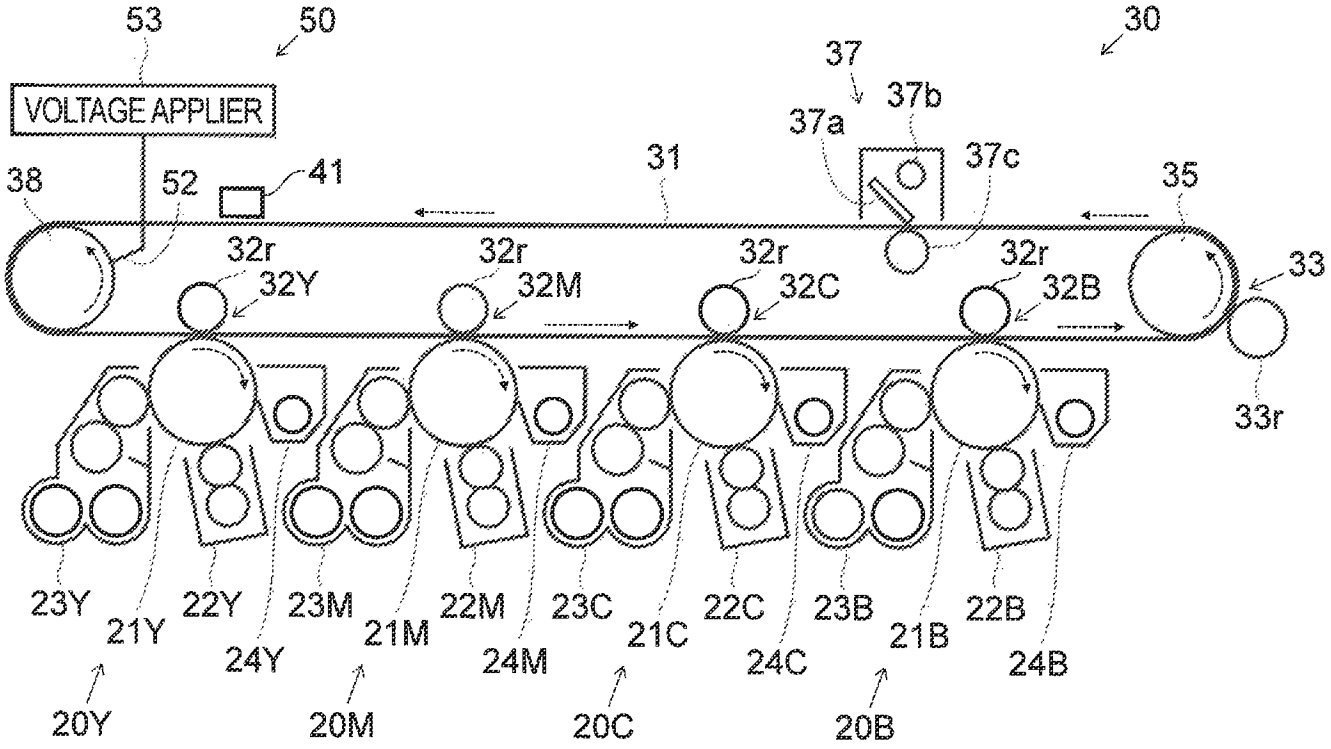
FIG. 6 is a sectional view showing a portion around a transfer portion of an image forming apparatus according to a modified example of the embodiment of the present disclosure.
Figure 7:
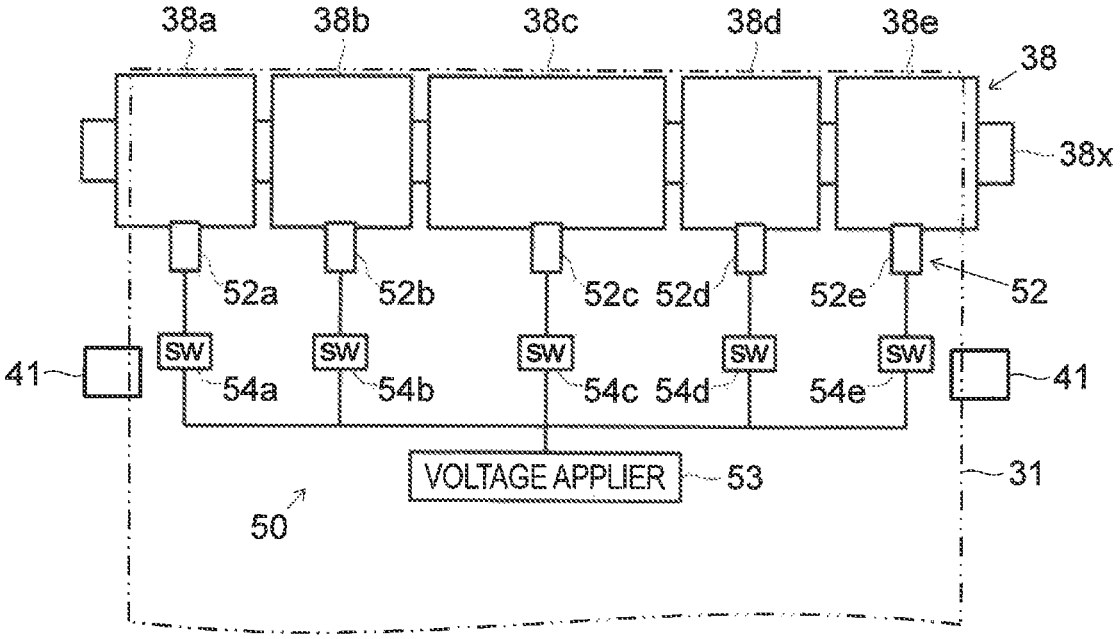
FIG. 7 is a top view showing an area around a driven roller of the image forming apparatus according to the modified example of the embodiment of the present disclosure.

Next, a description will be given of an image forming apparatus 1 of a modified example of the embodiment of the present disclosure, with reference to FIG. 6 and FIG. 7. FIG. 6 is a sectional view showing an area around a transfer portion of the image forming apparatus 1 of the modified example. FIG. 7 is a top view showing an area around a driven roller 38 of the image forming apparatus 1 according to the modified example. The image forming apparatus 1 according to the modified example includes a belt cleaning portion 37, a driven roller 38, and an attraction force changer 50 shown in FIG. 6 and FIG. 7.

The belt cleaning portion 37 is arranged away from the driven roller 38, at a position that is on a downstream side of a secondary transfer portion 33 but is on an upstream side of the driven roller 38 in the rotation direction of an intermediate transfer belt 31. The belt cleaning portion 37 includes, for example, a scraper 37*a*, a spiral conveyer 37*b*, and a counter roller 37*c*, The scraper 37*a* is opposed to the counter roller 37*c* with the intermediate transfer belt 31 interposed between them, is in contact with an outer circumferential surface of the intermediate transfer belt 31, and scrapes off toner and the like remaining on the outer circumferential surface of the intermediate transfer belt 31 after secondary transfer. The spiral conveyer 37*b* conveys the toner and the like having been scraped off by the scraper 37*a* from the outer circumferential surface of the intermediate transfer belt 31 into an unillustrated exhaust toner collection container provided outside the belt cleaning portion 37.

The driven roller 38 is divided into a plurality of regions in its rotation axis direction. The driven roller 38 is divided into, for example, five regions 38*a*, 38*b*, 38*c*, 38*d*, and 38*e* in its rotation axis direction. The five regions 38*a*, 38*b*, 38*c*, 38*d*, and 38*e* of the driven roller 38 are fixed to an axis portion 38*x* of the driven roller 38 at predetermined intervals in the rotation axis direction of the driven roller 38. Here, the number of regions into which the driven roller 38 is divided is not restricted to five. An outer circumferential surface of the driven roller 38 is preferably divided into at least three regions including a central part (the region 38*c*) and opposite end parts (regions 38*a* and 38*e*) in the rotation axis direction of the driven roller 38.

The attraction force changer 50 includes a contact member 52, a voltage applier 53, and a switch 54.

The contact member 52 is arranged adjacent to the driven roller 38. The contact member 52 is constituted by, for example, a conductive plate spring, a bar-shaped brush using conductive threads, or the like. The contact member 52 is in contact with an outer circumferential portion of the driven roller 38, and leads electricity outputted from the voltage applier 53 to the driven roller 38. The contact member 52 includes five contact members 52*a*, 52*b*, 52*c*, 52*d*, and 52*e* corresponding to the five regions 38*a*, 38*b*, 38*c*, 38*d*, and 38*e*, respectively, of the driven roller 38. The contact members 52*a*, 52*b*, 52*c*, 52*d*, and 52*e* are individually in contact with the five regions 38*a*, 38*b*, 38*c*, 38*d*, and 38*e*, respectively, of the driven roller 38.

The voltage applier 53 includes a power supply and a control circuit (of which neither is illustrated). The voltage applier 53 is electrically connected with the contact members 52*a*, 52*b*, 52*c*, 52*d*, and 52*e* via switches 54*a*, 54*b*, 54*c*, 54*d*, and 54*e*. The voltage applier 53 applies voltage to the five regions 38*a*, 38*b*, 38*c*, 38*d*, and 38*e* of the driven roller 38 via the contact members 52*a*, 52*b*, 52*c*, 52*d*, and 52*e*. This enables the attraction force changer 50 to change the electrostatic attraction force of the driven roller 38 with respect to the intermediate transfer belt 31 exerted on each of the opposite end sides of the driven roller 38 in its rotation axis direction.

In a case where a belt displacement detector 41 has detected the displacement of the intermediate transfer belt 31, the controller 9 makes the attraction force changer 50 increase the electrostatic attraction force of the driven roller 38 with respect to the intermediate transfer belt 31 exerted on the side of the driven roller 38 opposite to the side toward which the intermediate transfer belt 31 has been displaced.

With the configuration of the modified example described above as well as with the embodiment described previously, when the intermediate transfer belt 31 has been displaced, the electrostatic attraction force of the driven roller 38 with respect to the intermediate transfer belt 31 can be increased on the side opposite to the side toward which the displacement has taken place. This makes it possible to move the intermediate transfer belt 31 in a direction opposite to the direction in which the intermediate transfer belt 31 has been displaced. Thus, it is possible to keep suppressing meandering and twisting of the intermediate transfer belt 31 over a long period of time, without any component being worn out.

Further, in the image forming apparatus 1 of the modified example, the outer circumferential surface of the driven roller 38 is divided into at least three regions including a central part and opposite end parts in its rotation axis direction, and the attraction force changer 50 includes the contact member 52 and the voltage applier 53. With this configuration, it is possible to apply voltage directly to the driven roller 38. Thus, it is possible, with a simple configuration including a smaller number of components, to change the electrostatic attraction force of the driven roller 38 with respect to the intermediate transfer belt 31 exerted on each of the opposite end sides of the driven roller 38 in its rotation axis direction.

It should be understood that the embodiments of the present disclosure described above are in no way meant to limit its scope; the present disclosure can be implemented with any modifications made without departing from its spirit.

For example, although, in the embodiments described above, the image forming apparatus 1 is a tandem-type image forming apparatus for color printing, but the image forming apparatus 1 is not restricted to this type. The image forming apparatus 1 can also be a color-printing image forming apparatus of any type other than the tandem type, as long as it is provided with an intermediate transfer belt.

What is claimed is:

1. An image forming apparatus comprising:

a plurality of image forming portions which form toner images of different colors;

an intermediate transfer belt which is an endless belt wound around a drive roller and a driven roller, which is arranged along the plurality of image forming portions, and onto which the toner images respectively formed by the plurality of image forming portions are primarily transferred to be sequentially superimposed one on another;

a belt displacement detector which detects displacement of the intermediate transfer belt in a rotation axis direction of the driven roller;

an attraction force changer which is operable to change electrostatic attraction force of the driven roller with respect to the intermediate transfer belt exerted on each of opposite end sides of the driven roller in the rotation axis direction thereof; and a controller which controls operation of the attraction force changer, wherein, when the belt displacement detector detects the displacement of the intermediate transfer belt, the controller makes the attraction force changer increase the electrostatic attraction force of the driven roller with respect to the intermediate transfer belt exerted on a side of the driven roller opposite to a side toward which the displacement has taken place.

2. The image forming apparatus according to claim 1, wherein the driven roller has an outer circumferential surface which is divided into at least three regions including a central part and opposite end parts in the rotation axis direction of the driven roller, and the attraction force changer includes a contact member which individually contacts each of the regions of the driven roller, and a voltage applier which applies voltage to the regions of the driven roller via the contact member.

3. The image forming apparatus according to claim 1, wherein the attraction force changer includes a rotation body which rotates in contact with an outer circumferential surface of the driven roller substantially over an entire area in the rotation axis direction of the driven roller, and of which an outer circumferential surface is divided into at least three regions including a central part and opposite end parts in a rotation axis direction of the rotation body, a contact member which individually contacts each of regions of the rotation body, and a voltage applier which applies voltage to the regions of the rotation body via the contact member.

4. The image forming apparatus according to claim 1, wherein an electric resistance value of the driven roller when a voltage of 100 V is applied thereto is equal to or larger than $1.0\times10^{6}\Omega$.

5. The image forming apparatus according to claim 1, wherein a friction coefficient of an outer circumferential surface of the driven roller with respect to the intermediate transfer belt is smaller than a friction coefficient of an outer circumferential surface of the drive rover with respect to the intermediate transfer belt.

6. The image forming apparatus according to claim 1, wherein a surface hardness of the driven roller is higher than a surface hardness of the drive roller.

7. The image forming apparatus according to claim 1, wherein a lubricant is applied to an outer circumferential surface of the driven roller.

* * * * *